US005240339A

United States Patent [19]

DeForest et al.

[11] Patent Number: 5,240,339

[45] Date of Patent: Aug. 31, 1993

[54] BODY LOTION APPLICATOR WITH APPLICATOR HEAD PIVOTALLY MOUNTED ON TUBULAR EXTENSION ARM

[76] Inventors: Julie I. DeForest; Constance D. Kaplan, both of 2237 Vuelta San Marcos, Santa Fe, N. Mex. 87501; Armand G. Winfield, P.O. Box 1296, Santa Fe, N. Mex. 87504-1296

[21] Appl. No.: 767,910

[22] Filed: Sep. 30, 1991

[51] Int. Cl.[5] ..... A45D 34/04

[52] U.S. Cl. ..... 401/207; 401/266; 15/244.1; 15/244.2; 15/144.2; 403/223

[58] Field of Search ..... 401/203, 207, 196, 266, 401/205, 206, 204, 202; 15/144 A, 244.1–244.4; 403/223

[56] References Cited

U.S. PATENT DOCUMENTS

| | | | |
|---|---|---|---|
| 561,441 | 6/1896 | Schmidt | 403/223 X |
| 1,973,768 | 9/1934 | Knapp | 15/244.1 X |
| 2,876,476 | 3/1959 | Woods | 401/207 X |
| 3,857,133 | 12/1974 | Linenfelser | 15/244.3 X |
| 4,553,871 | 11/1985 | Niles | 401/196 X |
| 4,603,904 | 8/1986 | Tolleson et al. | 403/223 X |
| 4,611,941 | 9/1986 | Karliner et al. | 401/207 |
| 4,822,194 | 4/1989 | Simonette | 401/207 |
| 4,961,661 | 10/1990 | Sutton et al. | 401/207 X |

*Primary Examiner*—Danton D. DeMille
*Attorney, Agent, or Firm*—William A. Eklund

[57] ABSTRACT

A body lotion applicator with an extended applicator head for reaching the back and other portions of the body that are difficult to reach. An elongate arm serves as a handle and conduit for conducting body lotions from a conventional bottle to the applicator head. The applicator head includes a face plate and porous sponge affixed thereto by a retaining ring. The sponge preferably consists of an outer layer of a small cell, open-cell foam and an inner body of a large cell, open-cell foam. The sponge is detachable from the head and is replaceable with a coarse-celled exfoliative sponge or similar sponge assembly.

18 Claims, 13 Drawing Sheets

BODY LOTION APPLICATOR WITH APPLICATOR HEAD PIVOTALLY MOUNTED ON TUBULAR EXTENSION ARM

BACKGROUND OF THE INVENTION

1. Field of the Invention

The invention described and claimed herein is generally related to devices for storing and dispensing body lotions and similar liquids. More particularly, the present invention is directed to apparatuses for dispensing and applying body lotions, such as moisturizing lotions, skin care lotions or sunscreens, onto the back and other parts of the body that are ordinarily difficult to reach.

2. Description Of Related Art Including Information Disclosed Under 37 CFR 1.97–1.99

Moisturizing lotions, skin care lotions and sunscreens must typically be applied regularly, uniformly and consistently over large skin areas of the body to achieve optimum effectiveness. Most individuals find it difficult or impossible to apply such body lotions to their backs unassisted. Many individuals also have difficulty applying such lotions to their lower legs or other areas which may be hard to reach due to chronic back problems, arthritic joint conditions and the like. Those areas of the body that require twisting, reaching or bending to access can cause considerable difficulty for individuals afflicted with such conditions, particularly when required on a daily or more frequent repetitive basis.

Various devices have previously been commercially available for the purpose of dispensing lotions and other liquids. Few of these devices however are suitable for application of a lotion directly to the body, and fewer still are suitable in any way for applying lotion to parts of the body that are hard to reach.

Accordingly, it is the object and purpose of the present invention to provide a device that permits application of a lotion to parts of the body that are ordinarily beyond reach.

It is also an object and purpose of the present invention to provide a device which attains the foregoing object and purpose, and which may be used repetitively.

It is another object and purpose to provide a device which attains the foregoing objects and purposes, and which universally attaches to common retail bottles of lotion so as to serve both as an applicator and as a cap for the bottle of lotion.

It is yet another object and purpose of the present invention to provide a device which attains the foregoing objects and which also applies a lotion to large areas of the body in a uniform and consistent manner.

SUMMARY OF THE INVENTION

These and other objects and purposes are attained in the body lotion applicator of the present invention, which includes an applicator head affixed to one end of an elongate tubular arm. The applicator head includes an open-celled applicator sponge that is retained in place on an applicator face plate by a retaining ring. Lotion is distributed through the tubular arm and applicator body and is dispersed evenly through the applicator sponge. In a preferred embodiment the sponge consists of two layers; an outer layer consisting of a small cell, open-cell foam, and an inner body of a large cell, open-cell foam. In another preferred embodiment the sponge consists of a single, large open-cell foam, which may be used dry as an exfoliator.

In a preferred embodiment the applicator head is attached to the tubular arm through a flexible tubular coupler that permits limited universal pivotal motion of the head with respect to the tubular arm, thereby facilitating angular adaption of the applicator head to the surface of the body, thereby ensuring uniform application of body lotion to the body. Lotion is preferably delivered through a flexible tube which passes through the arm, the flexible coupler, and a base member which is threadably enaged with the face plate.

These and other aspects of the present invention will be more apparent upon consideration of the following detailed description of the invention, when taken with the accompanying drawings.

BRIEF DESCRIPTION OF THE DRAWINGS

The Figures set forth in the accompanying drawings form a part of this specification and are hereby incorporated by reference. In the Figures.

DESCRIPTION OF THE PREFERRED EMBODIMENT

Figure 1:
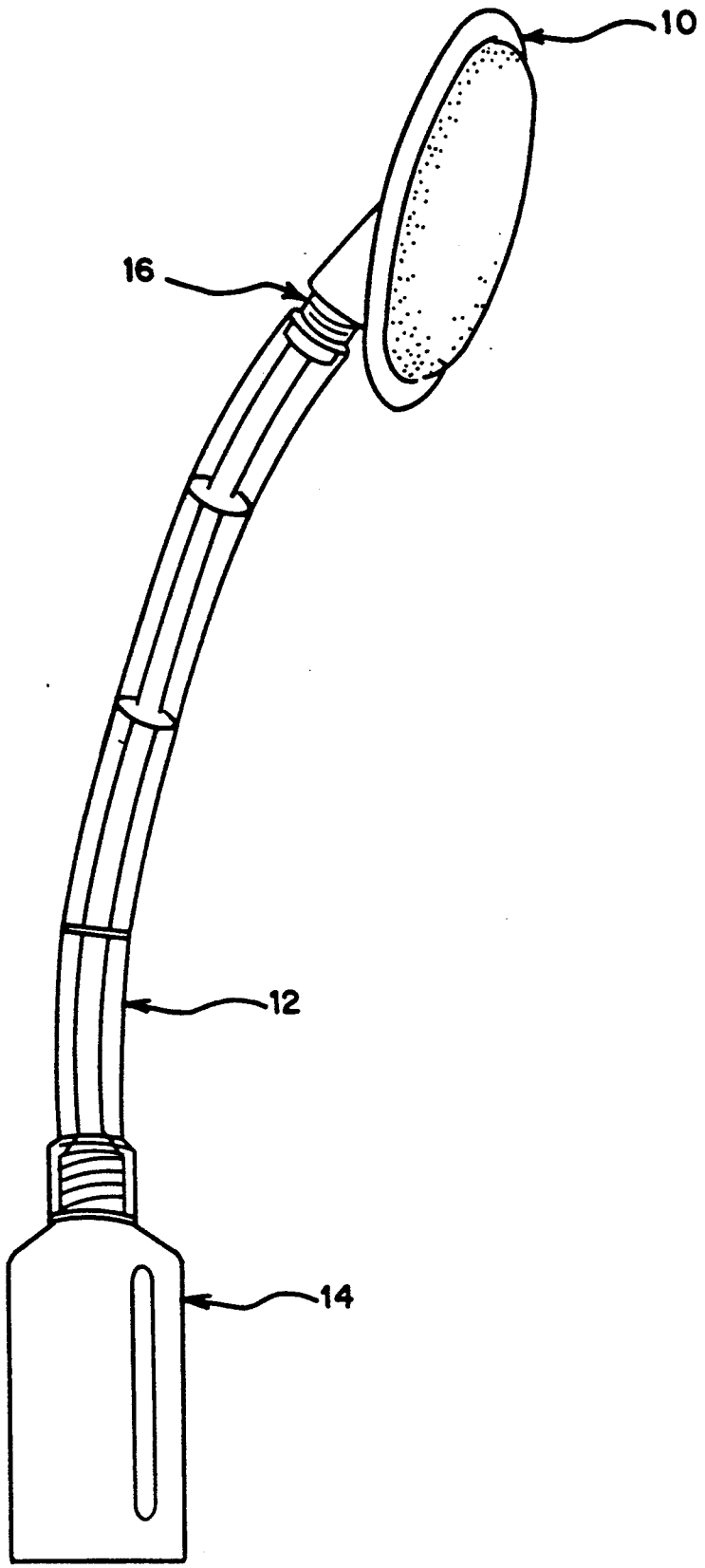
FIG. 1 is an isometric view of a preferred embodiment of the lotion applicator of the present invention, as it is installed on a polymeric bottle suitable for containing a moisturizing lotion, skin care lotion, sunscreen or other body lotion.

Referring to FIGS. 1 through 7, there are illustrated various aspects of a preferred embodiment of the body lotion applicator of the present invention, which includes generally an applicator head 10 that is flexibly affixed to the upper end of an elongate, arcuate, tubular extension arm 12. The applicator is illustrated in FIG. 1 as being attached to a flexible polymeric lotion bottle 14, which in the case of FIG. 1 forms no part of the present invention.

The applicator head 10 is connected to the upper end of the tubular arm 12 by a flexible elastomeric tubular coupler 16 which allows the applicator head 10 to pivot over a limited universal angular relation with respect to the tubular arm 12. The tubular coupler 16 is preferably formed of an 85 durometer flexible polyvinyl chloride. The coupler 16 may alternatively be formed of a polyurethane of similar durometer, or of other flexible polymers having similar physical characteristics.

The tubular arm 12 and the applicator head 10 may preferably be formed of an impact modified acrylic, polycarbonate, or other suitable ultraviolet resistant, high impact, suitable moldable polymeric plastics materials, as well as of modified rubbers or latices and other suitable materials.

Figure 2:
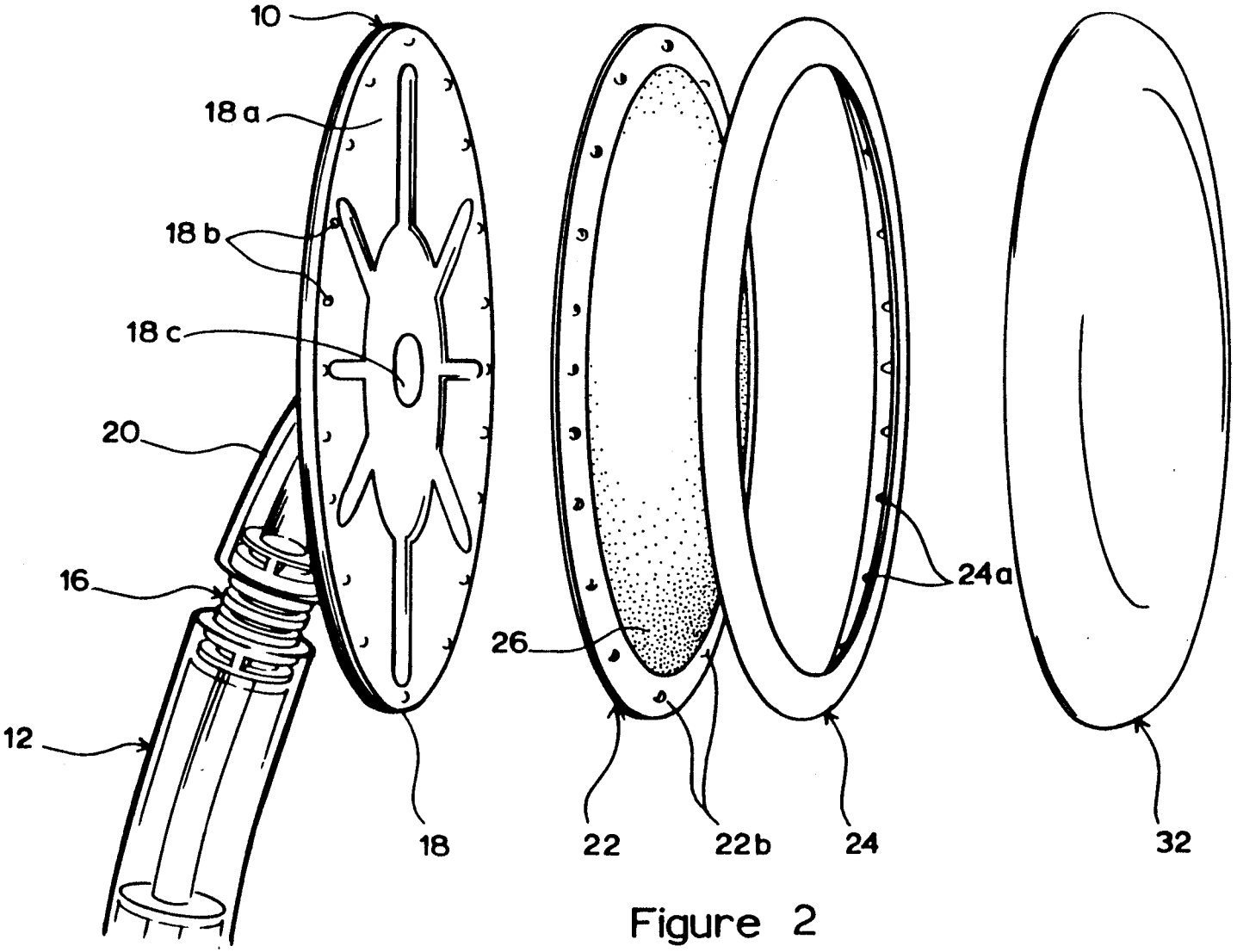
FIG. 2 is an exploded isometric view of the head of the applicator shown in FIG. 1, illustrating a convex transparent cover plate, retaining ring, applicator sponge, and applicator head.
Figure 3:
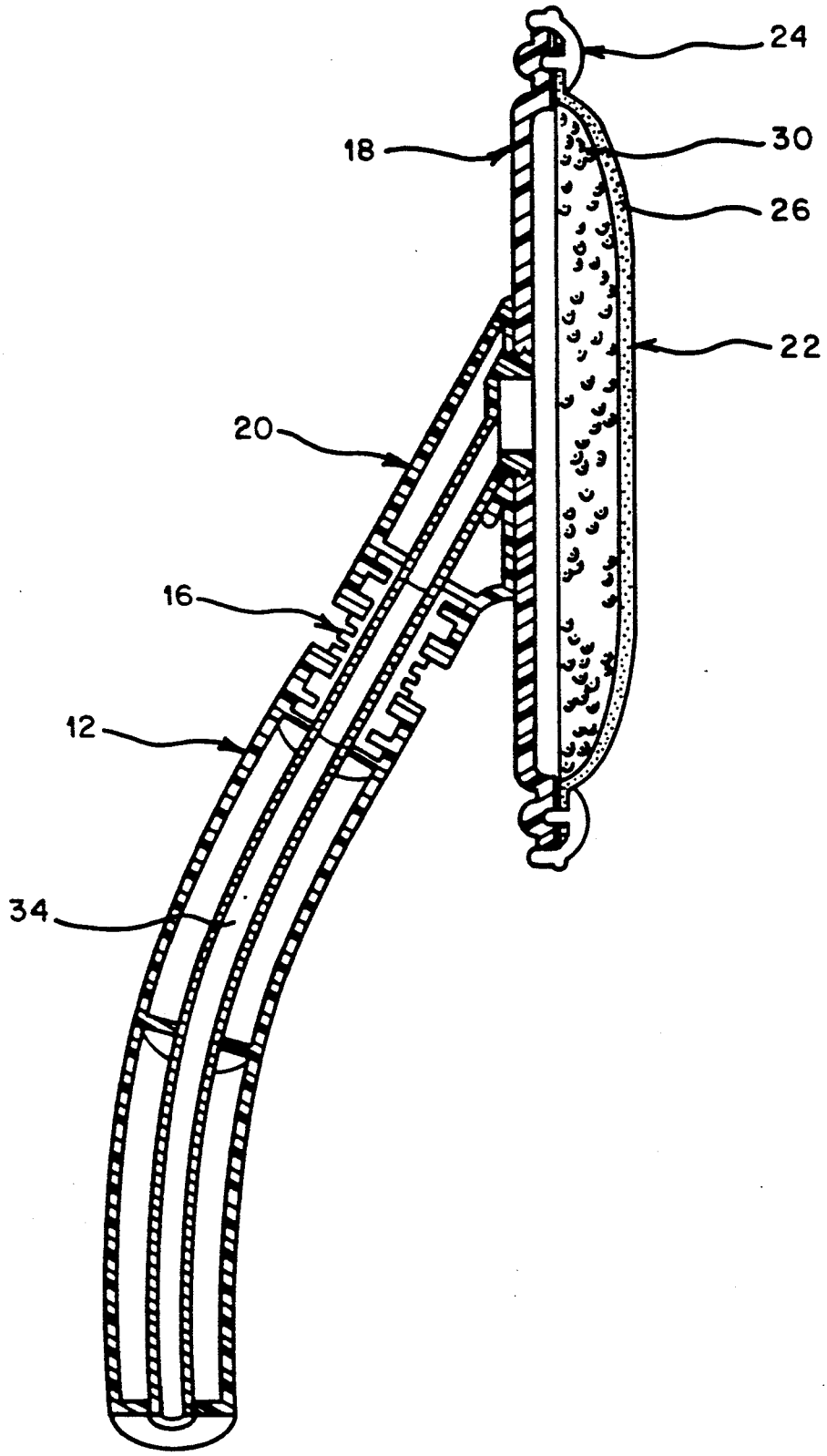
FIG. 3 is a side view in cross section of the head of the applicator of FIG. 1.
Figure 4:
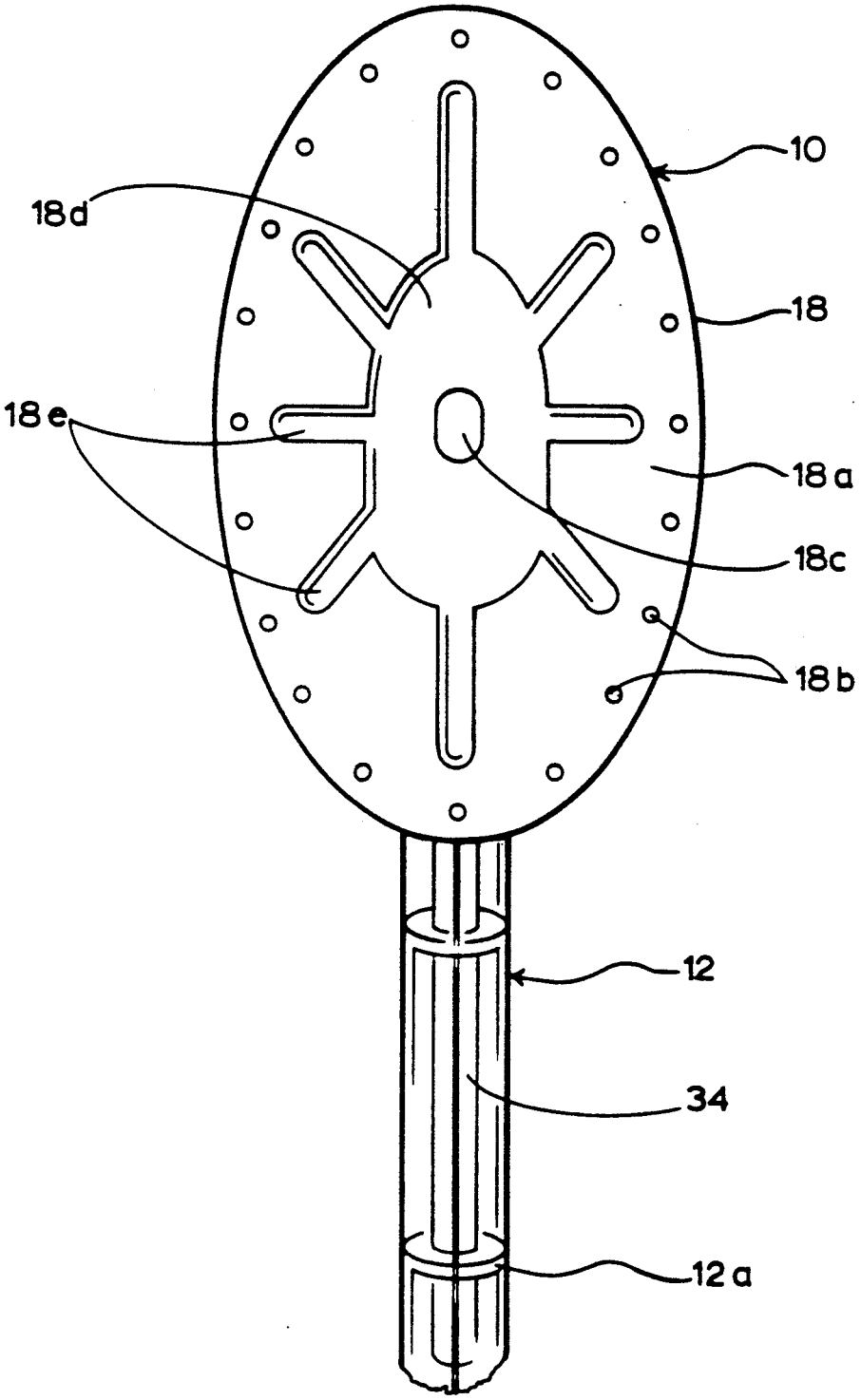
FIG. 4 is a front view of the head of the applicator shown in FIG. 1, with the applicator sponge removed.
Figure 5:
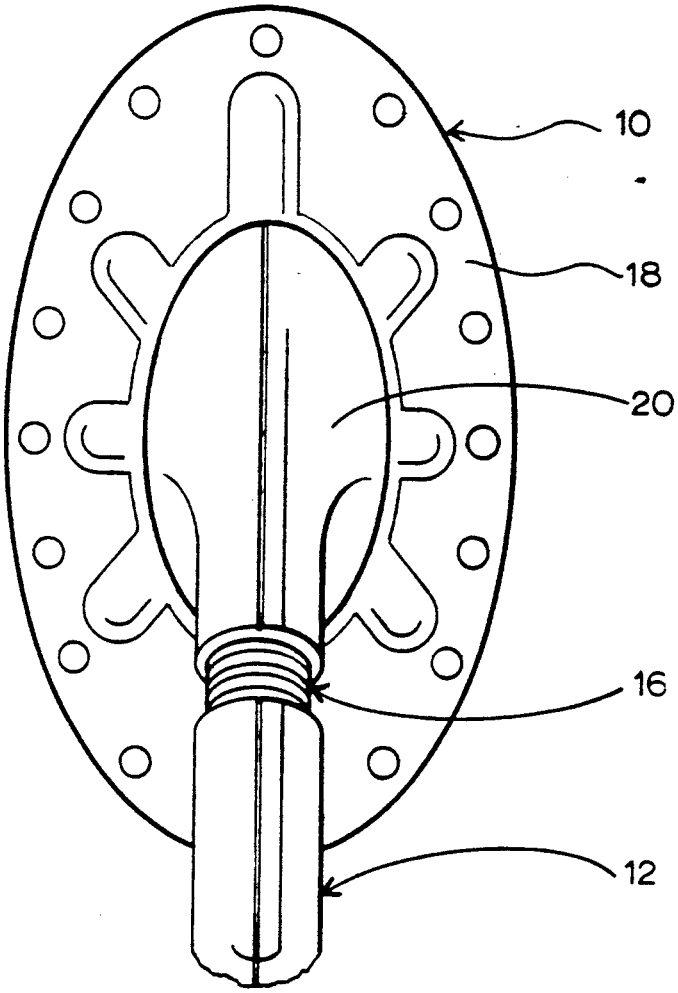
FIG. 5 is a rear view of the applicator head of FIG. 1.
Figure 6:
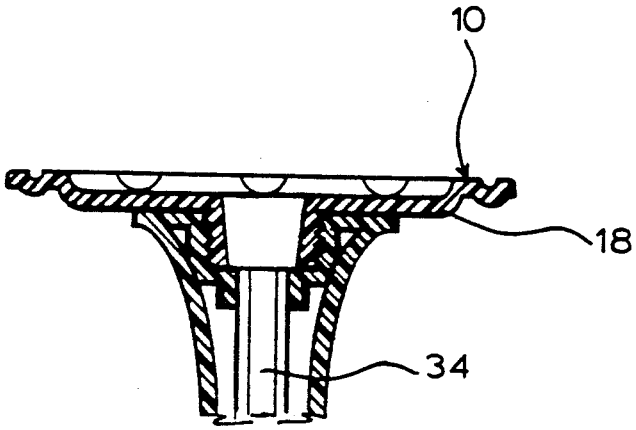
FIG. 6 is a top end view in cross section of the head of the applicator of FIG. 1.

Referring to FIGS. 2 through 4, the applicator head 10 includes two mutually detachable parts; an oval face plate 18 and a cooperable base member 20. The face plate 18 includes a threaded tubular plug which threads into cooperably threaded bore in the base member 20, as shown for example in FIGS. 3 and 6.

The face plate 18 may be round or oval in shape as illustrated, and includes a flat outer surface 18*a* (FIG. 4). The peripheral edge of the face plate surface 18*a* includes multiple small spaced indentations 18*b*, which serve to engage and retain the applicator sponge described in greater detail below.

The applicator face plate 18 further includes a central bore 18*c* which opens into a manifold recess 18*d* that opens onto the face plate surface 18*a*. The manifold recess 18*d* includes multiple recess arms 18*e* which serve to distribute lotion uniformly to the applicator sponge described below.

Figure 8:
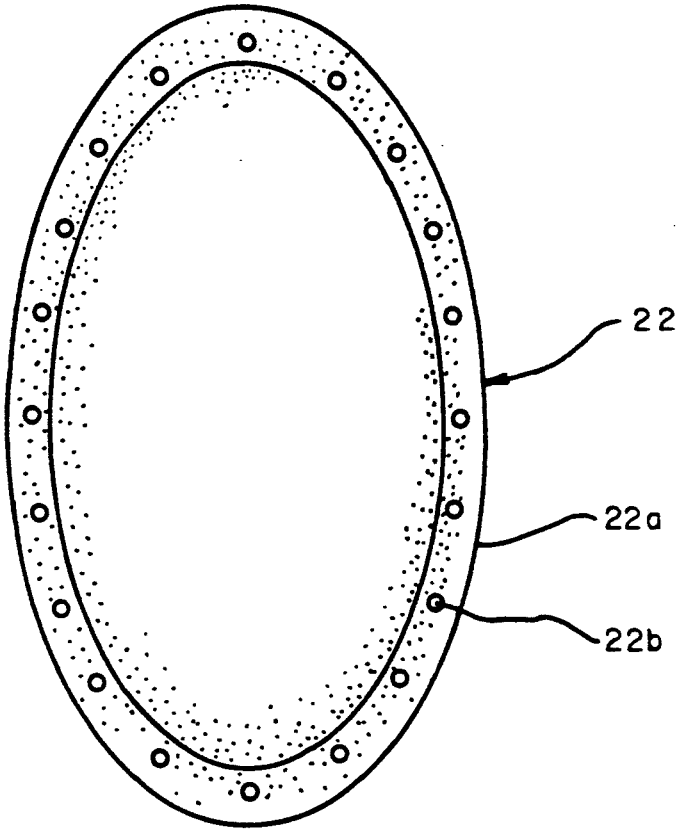
FIG. 8 is a front view of the applicator sponge of the applicator of FIG. 1.

An applicator sponge 22, which is round or oval to conform to the shape of the face plate, is affixed to the face plate 18 by a retaining ring 24. The sponge 22 preferably consists of an outer layer 26 of a small cell, open-cell polyurethane foam, and an inner body 28 of a large cell, open-cell polyurethane foam, as shown in FIGS. 8 through 10.

The sponge 22 is compressed and fused along its outer perimeter. This is done in a separate operation prior to installation to form a flat, dense peripheral strip 22*a*. Holes 22*b* are formed in the peripheral strip 22*a*. The retaining ring 24 includes pointed pins 24*a* which correspond with the holes 22*b* in the peripheral strip and the indentations 18*b* in the outer surface 18*a* of the face plate 18. In assembly of the applicator head 10, the retaining ring 24 is permanently crimped about the peripheral edge of the face plate 18. In so doing the pins 24*a* pierce the peripheral strip 22*a* of the sponge 22 and engage the indentations 18*b*, thereby securing the peripheral strip 22*a* of the sponge 22 firmly against the peripheral edge of the face plate 18. Heat crimping or ultrasonic crimping of the retaining ring 24 onto the face plate 18 enables the sponge 22 to withstand fluid pressures created under the sponge 22 when lotion is interjected into and through the sponge 22.

Figure 9:
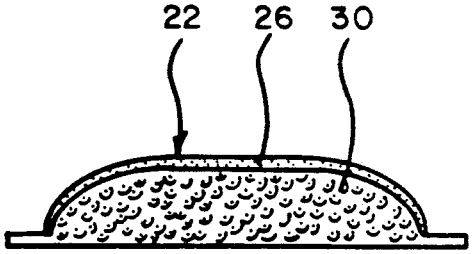
FIG. 9 is a side view in cross section of the sponge of FIG. 3.
Figure 11:
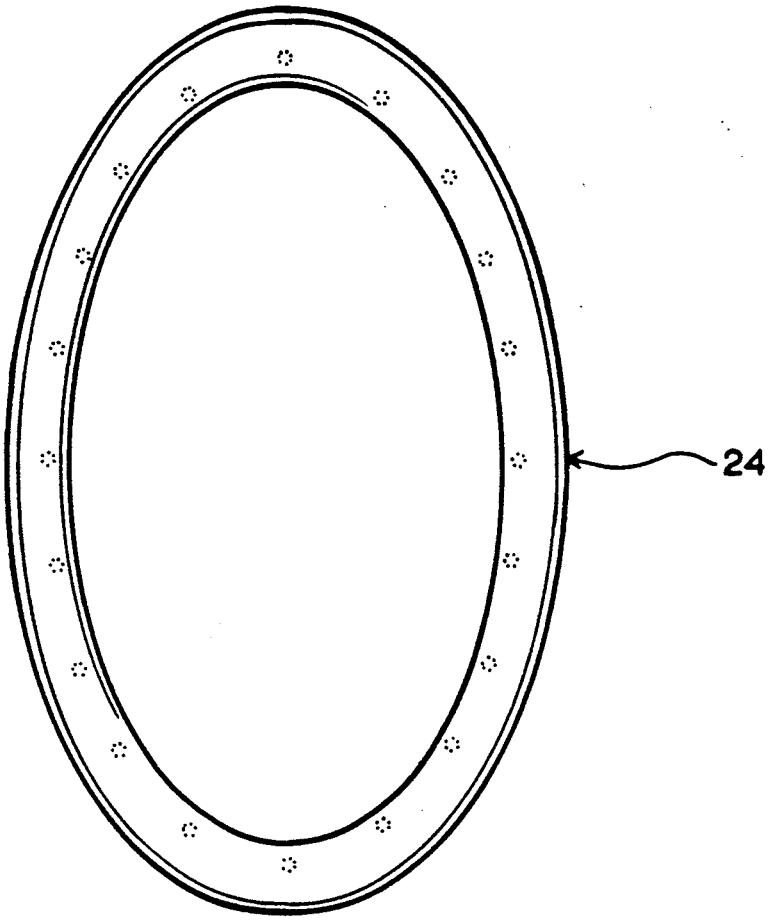
FIG. 11 is a front view of the retaining ring of the applicator head.
Figure 12:
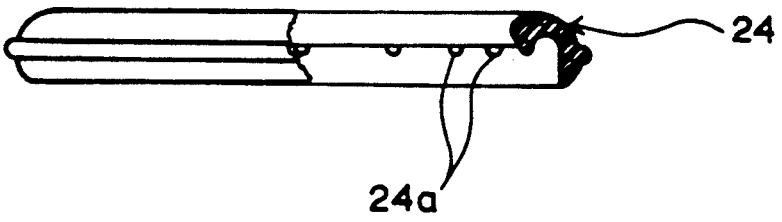
FIG. 12 is a side view in cross section of the retaining ring of FIG. 8.

Referring to FIG. 9, the sponge 22 preferably includes a outer surface layer 26 that consists of a small-cell, open-cell foam, which preferably has approximately 80 pores per inch. The sponge 22 also includes an inner body 28 that consists of a large-cell, open-cell foam, which preferably has approximately 20 pores per inch. The outer surface layer 26 and the inner body 28 are fused together along the peripheral strip 22*a*. The inner body 28 provides shape to the sponge 22 while also allowing free flow of a viscous lotion through the sponge 22 The outer surface layer 26 provides a smooth, soft surface that is pleasant to the touch while also being sufficiently porous to allow uniform flow of lotion therethrough.

Figure 10:
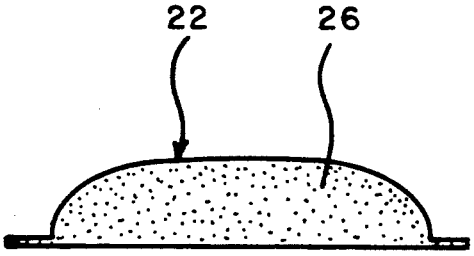
FIG. 10 is a side view in cross section of an alternative embodiment of a sponge having a coarse-celled open cell foam body.

In an alternative embodiment, shown in FIG. 10, a coarse-cell, open-cell foam is employed to form a sponge 30 that is particularly useful as an exfoliator for scrubbing the skin. The coarse sponge 30 may be used dry or with an exfoliating cream or scrub to provide an exfoliative composition that is somewhat flexible so as to conform to the skin surface of the body.

Figure 13:
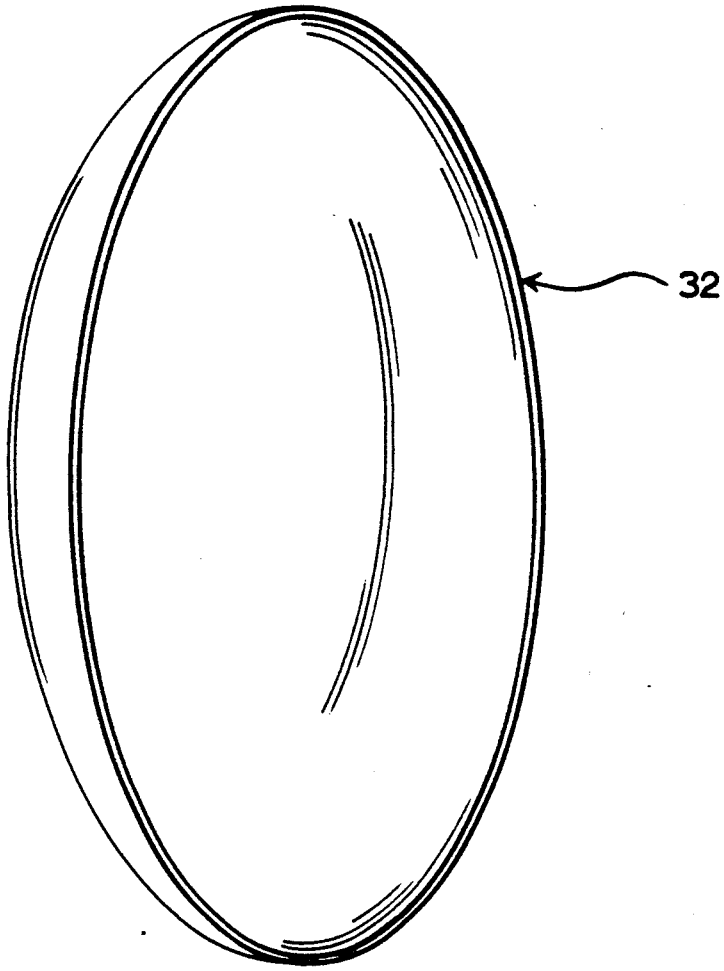
FIG. 13 is an isometric view of a transparent cover plate for the applicator shown in FIG. 1.
Figure 14:
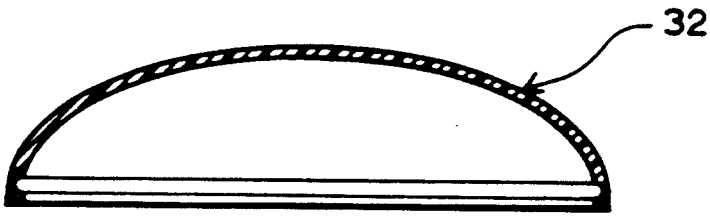
FIG. 14 is a side view in cross section of the cover plate shown in FIG. 10

Referring to FIGS. 2, 13 and 14, a transparent cover 32 is employed to cover the sponge 22 when not in use. The cover 32 snap-fits onto the retaining ring 24 to keep the sponge 22 from drying out and to exclude dirt from the sponge surface.

Figure 7:
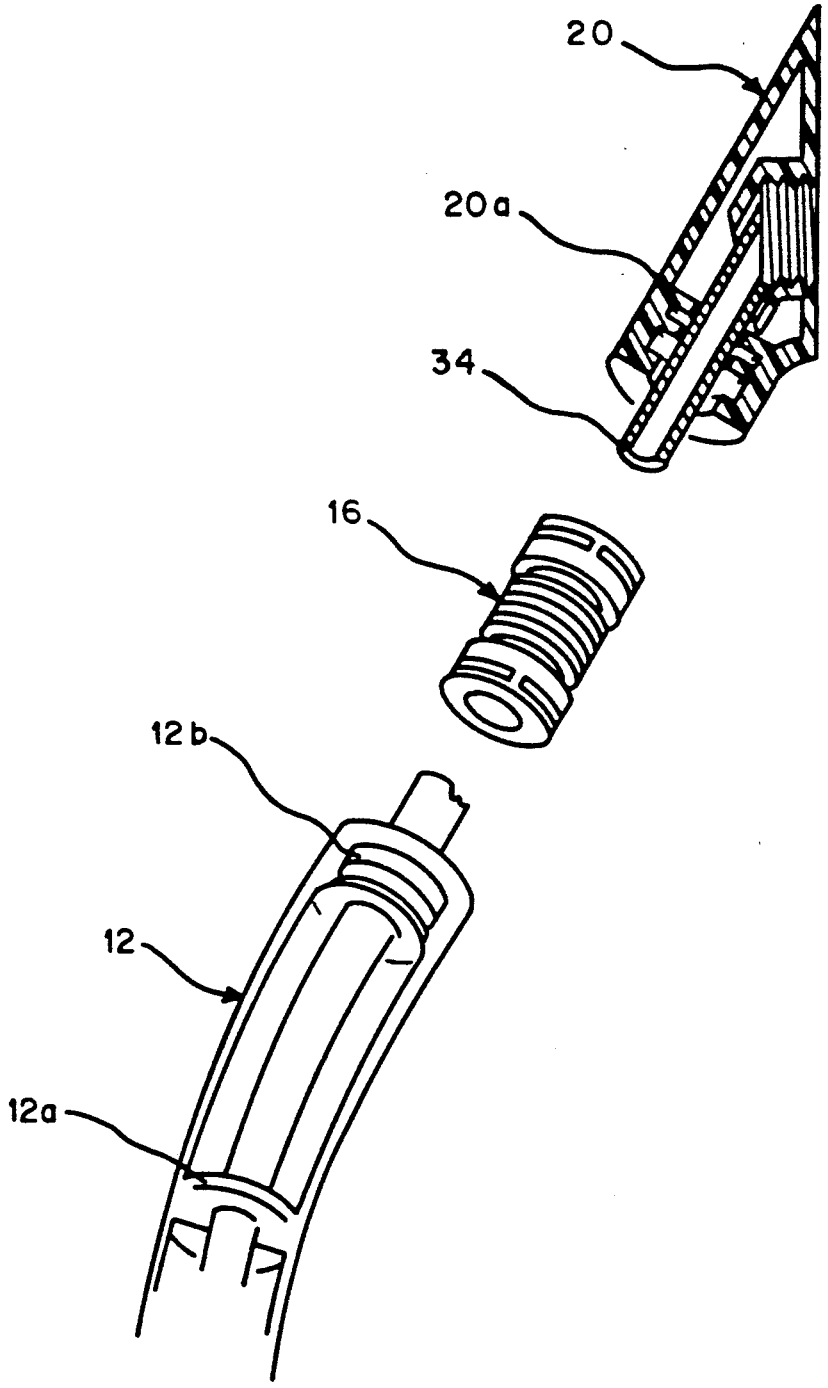
FIG. 7 is an exploded isometric view of the tubular arm, flexible coupler and base of the applicator head.

Lotion is transported through the tubular arm 12 in a tube 34 that extends from the lower end of the arm 12, through the flexible coupler 16, and to the bore 18*c* of the face plate 18. The tube 34 is preferably a flexible tube formed of flexible polyvinyl chloride or similar material. The tube 34 is positioned in the arm 12 by means of multiple integral spaced-apart webs 12*a* formed in the longitudinal bore of the arm 12, as illustrated in FIG. 7.

During assembly the tube 34 is first sealed to the opening of the lower end of arm 12, then is threaded through the coupler 16 and the base member 20. Once the base member 20 and coupler 16 are in place, the tube 34 is cut flush with the opening of the base member 20 and is sealed in place with appropriate cement or heat or ultrasonic sealing treatment. Thereafter the face plate 18 can be removed as desired without breaking the seal of the continuous tube 34. Alternatively, the tube 34 may be formed of a rigid material and may be cemented to opposite ends of the coupler 16.

The coupler 16 is shaped to cooperably engage a set of internally opening annular grooves 12*b* formed in the upper end of the arm 12 and a similar set of internal annular grooves 20*a* formed in the end of the lower end of the base member 20.

In use, lotion from a dispensing bottle is pumped manually through the tube 34 is distributed through the manifold recess 18*d* and the recess fingers 18*e* and is introduced therefrom into the sponge 22. The lotion passes through the sponge 22, wherein it is evenly dispersed, and is evenly dispensed from the outer surface of the sponge 22, from which it can be applied evenly to the back or other hard to reach areas of the body.

The face plate 18 and associated sponge 22 are removable by simply disengaging the face plate 18 from the base member 20. This allows for replacement of the sponge 22 when necessary due to normal wear, or to exchange the sponge with an exfoliator sponge, or to replace the sponge to dispense a different type of lotion.

Figure 15:
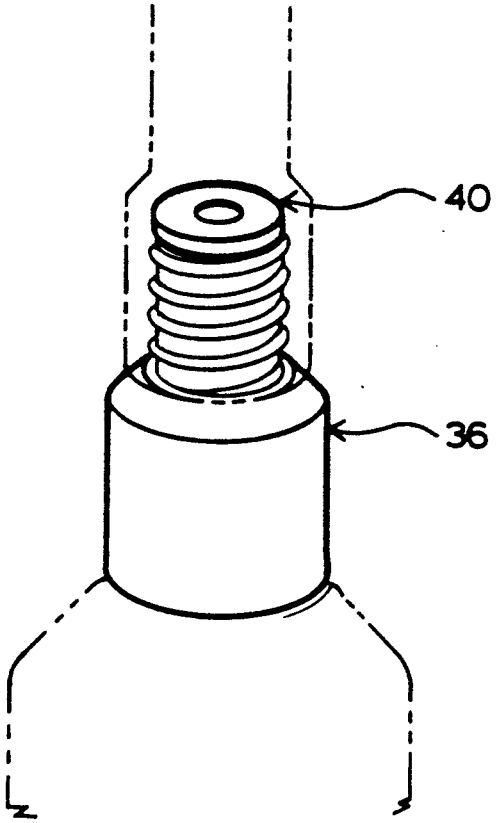
FIG. 15 is an isometric view of a preferred adaptor that is used to connect the lower end of the extension arm to a lotion bottle, with the lotion bottle and arm shown in phantom outline.
Figure 16:
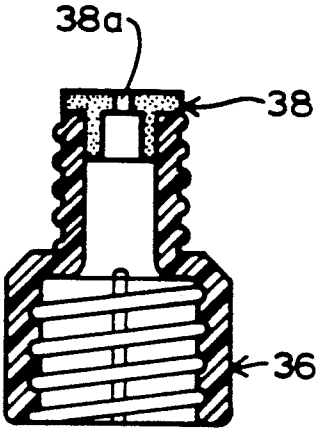
FIG. 16 is a side view in cross section of the preferred adaptor of FIG. 15.
Figure 17:
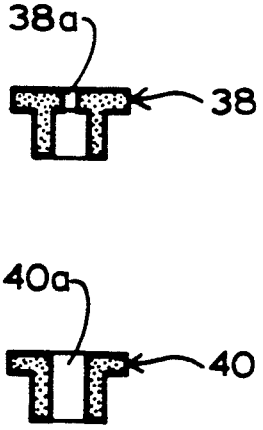
FIG. 17 is a elastomeric gasket used to reduce the flow of low viscosity lotions and also seal the connection between the adaptor and the lotion bottle.

FIGS. 15 through 22 illustrate several embodiments of adaptors which allow the arm 12 to be removably attached to the primary commercially available flexible lotion bottles. FIGS. 15 and 16 for example show a rigid impact modified acrylics adaptor 36 which is internally threaded at its lower end, for engagement with a threaded lotion bottle, and which is externally threaded at its upper end for engagement with threaded opening of the arm 12. The adaptor 36 may also be formed of polycarbonate. A pair of elastomeric gaskets 38 and 40 (FIG. 17) are used to reduce fluid flow of particularly fluid lotions as well as to form a fluid-tight seal between the arm 12 and the attached lotion bottle. The gaskets 38 and 40 may be formed of a flexible polyurethane or similar elastomeric material. The gasket 38 has a small bore 38*a* and is positioned at the top of the adaptor 36, sealing the adaptor against the interior bore of the arm 12. The second gasket 40 fits at the top of a lotion bottle, and seals the bottle against the adaptor 36, as shown in FIG. 16. Gasket 40 has a bore 40*a* which is a somewhat larger diameter than the bore 38*a* of gasket 38. The bores 38*a* and 40*a* reduce the flow of lotions and prevent dripping or run-off at the sponge 22. The diameters of the bores of the gaskets 38*a* and 40*a* may be vary depending on the viscosity of the particular lotion being used.

The adaptor 36 also includes a narrow cut 36*a* in the lower threads. The cut is approximately 1/16 inch deep and wide, and serves to allow air to penetrate between the lotion bottle and the tube, preventing air locks yet without allowing leakage of the lotion.

Figure 18:
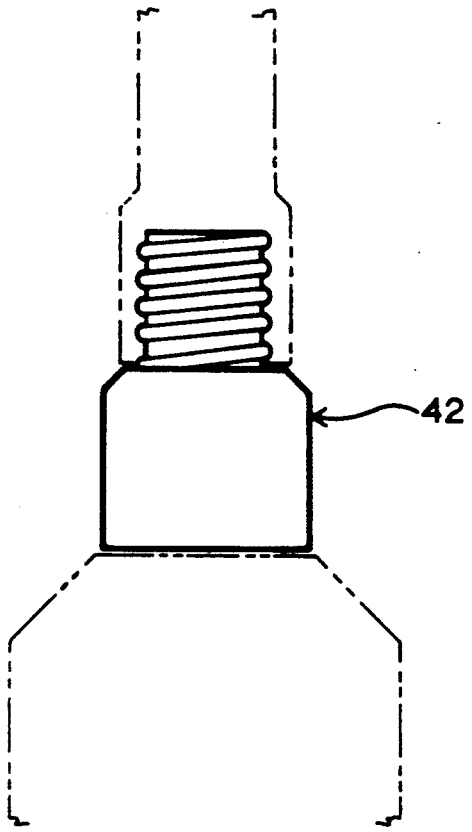
FIG. 18 is a side view of another adaptor.
Figure 19:
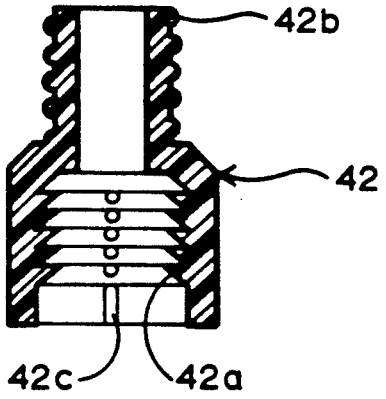
FIG. 19 is a side view in cross section of the adaptor of FIG. 18.

FIGS. 18 and 19 show a similar adaptor 42 which includes multiple internal flexible flanges 42*a* in its lower end, which replace the helical threads of the adaptor 36 described above. The adaptor 42 includes external threads 42*b* at its upper end for engagement with the arm 12. Adaptor 42 is preferably formed of a flexible polyurethane of 65 to 85 Durometer, or similar material, and is for lotion bottles which have nonstandard threads or even no threads at all. Adaptor 42 also includes a groove 42*c* to prevent airlock.

Figure 20:
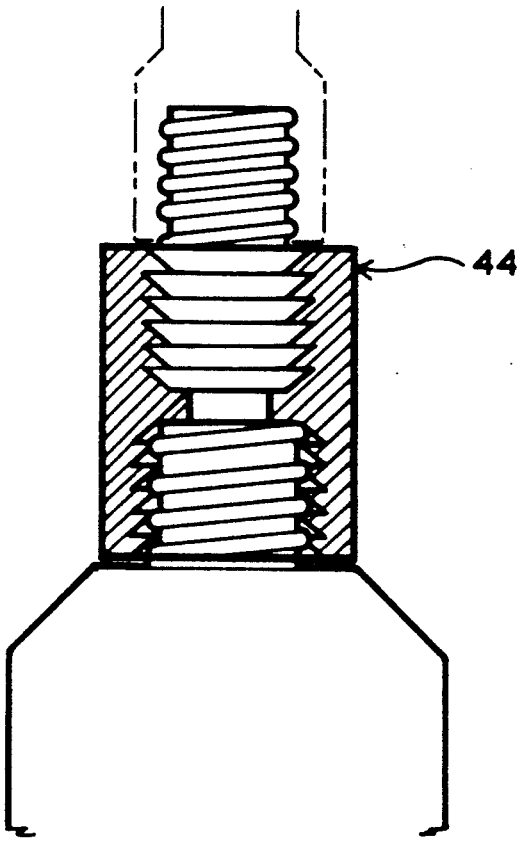
FIG. 20 is a side view of another preferred adaptor.
Figure 21:
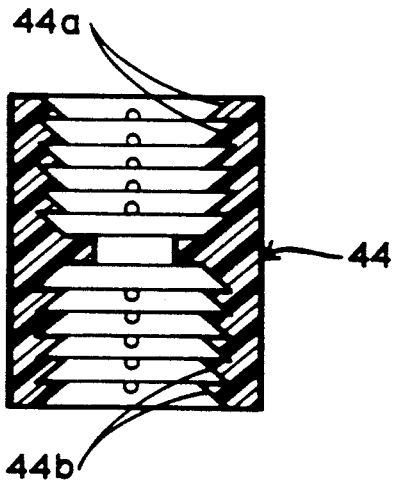
FIG. 21 is a side view in cross section of the adaptor shown in FIG. 20.

FIGS. 20 and 21 show another adaptor 44 which includes multiple concentric flexible flanges 44*a* and 44*b* at its upper and lower ends respectively. Adaptor 44 is also preferably formed of a flexible polyurethane having a Durometer hardness of 65 to 85.

Figure 22:
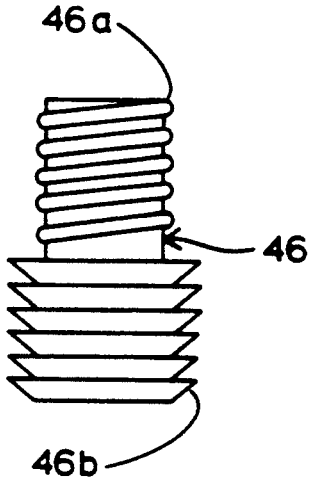
FIG. 22 is a side view of another alternative adaptor.

FIG. 22 shows a plug-type adaptor 46, also formed of 65–85 Durometer flexible polyurethane, which includes external threads 46*a* at its upper end for engagement with the arm 12, and concentric flexible flanges 46*b* at its lower end.

Figure 23:
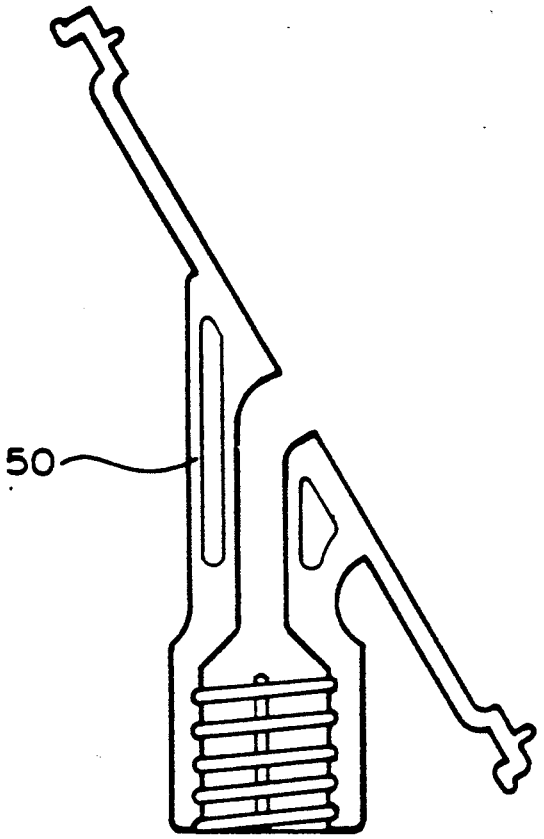
FIG. 23 is a side view in cross section of an alternative applicator head.

FIG. 23 illustrates an alternative applicator head 48, which includes a base member 50 having an internally threaded opening at its lower end. Applicator head 48 is designed for applications not requiring a particularly extended support arm, and can be affixed directly to a conventional lotion bottle, either directly by means of the internal threads in the base 50 or through one of the adaptors described above.

The present invention has been described and illustrated with reference to one or more preferred embodiments. Nevertheless, it will be understood that various modifications, alterations and substitutions may be apparent to one of ordinary skill in the art, and that such modifications, alterations and substitutions may be made without departing from the essential invention. Accordingly, the present invention is defined only by the following claims.

The embodiments of the invention in which patent protection is claimed are:

1. A body lotion applicator comprising an applicator head pivotably mounted on a tubular extension arm, said applicator head including an applicator face plate having a generally outer surface, said applicator head and said extension arm including internal conduit means for transmitting a body lotion through said arm and through said applicator head to said face place, an applicator sponge mounted against said face plate, said sponge being retained against said face plate by a retaining ring that cooperably fits over a peripheral edge of said face plate, said applicator head including a peripheral flange around the perimeter of said face plate, said peripheral flange including a plurality of spaced indentations in said outer surface, and wherein said retaining ring includes a plurality of spaced pins corresponding with said indentations, said pins passing through corresponding holes formed in said peripheral edge of said sponge to thereby retain said sponge in place, said applicator sponge being formed of an open-celled foam operable to disperse and evenly dispense a body lotion pumped through said tubular arm and said applicator head and into said applicator sponge.

2. The body lotion applicator defined in claim 1 further comprising a flexible tubular coupler connecting said applicator head to said tubular arm, said tubular coupler having a plurality of outer flanges which engage corresponding inner grooves in said tubular arm and in a tubular base member of said applicator head.

3. The body lotion applicator defined in claim 2 wherein said coupler is a flexible polyurethane coupler having a Durometer hardness of at least 85.

4. The body lotion applicator defined in claim 1 wherein said arm includes a threaded bore at its lower end for engagement with a lotion bottle.

5. The body lotion applicator defined in claim 1 further comprising an adaptor for attaching a lower end of said tubular arm to a squeezable lotion bottle.

6. The body lotion applicator defined in claim 5 wherein said adaptor is formed of a polymer selected from the group consisting of impact modified acrylics, polycarbonates, and rigid polyvinyl chlorides.

7. The body lotion applicator defined in claim 5 wherein said adaptor includes flexible internal flanges and is formed of a polyurethane having a Durometer hardness fo 65 to 85.

8. The body lotion applicator defined in claim 1 wherein said sponge is formed of a large-cell, open-cell polymeric foam.

9. The body lotion applicator defined in claim 8 wherein said sponge further includes an outer layer of a small-cell, open-cell polymeric foam.

10. The body lotion applicator defined in claim 1 further including a tube extending through said tubular arm and through said coupler and through said applicator head, to open onto said outer surface of said face plate, whereby lotion may be delivered through said tube to said sponge.

11. A body lotion applicator comprising an applicator head, an elongate tubular arm affixed to said head, means for affixing said elongate arm to a lotion bottle, said applicator head including an applicator body having a planar face plate and including a conduit opening onto said face plate, a porous polymeric sponge, said sponge being retained against said face plate by retaining ring that is crimped over a peripheral edge of said face plate, said applicator head including a peripheral flange around the perimeter of said face plate, said peripheral flange including a plurality of spaced indentations in said face plate, said retaining ring having spaced corresponding pins which retain said sponge in place upon being crimped onto said face plate, whereby body lotion may be dispensed from said lotion bottle through said tubular arm and through said applicator head and said sponge to be spread evenly onto the back or other hard to reach areas of the body.

12. The body lotion applicator defined in claim 11 further comprising a flexible tubular coupler connecting said applicator head to said tubular arm, said tubular coupler having a plurality of outer flanges which engage corresponding inner grooves in said tubular arm and in a tubular base member of said applicator head.

13. The body lotion applicator defined in claim 12 wherein said coupler is formed of a flexible polyurethane or polyvinyl chloride having a Durometer hardness of at least 85.

14. The body lotion applicator defined in claim 11 further comprising an adaptor for attaching a lower end of said tubular arm to a lotion bottle.

15. The body lotion applicator defined in claim 14 wherein said adaptor is a threaded adaptor formed of polymer selected from the group consisting of impact modified acrylics and polycarbonates.

16. The body lotion applicator defined in claim 11 wherein said sponge is formed of a large cell, open-cell polymeric foam.

17. The body lotion applicator defined in claim 16 wherein said sponge further includes an outer layer of a small cell, open cell polymeric foam.

18. The body lotion applicator defined in claim 11 wherein said tubular arm is formed of a molded polymer selected from the group consisting of impact modified acrylics and polycarbonates.

* * * * *